United States Patent [19]

Prickett

[11] Patent Number: 5,067,061

[45] Date of Patent: Nov. 19, 1991

[54] DECORATIVE EXTERIOR TRIM LIGHTING SYSTEM

[76] Inventor: Robert B. Prickett, 3816 Mockingbird La., Dallas, Tex. 75205

[21] Appl. No.: 575,154

[22] Filed: Aug. 29, 1990

Related U.S. Application Data

[63] Continuation-in-part of Ser. No. 464,200, Jan. 12, 1990, Pat. No. 4,974,128.

[51] Int. Cl.[5] ..... F21S 1/02

[52] U.S. Cl. ..... 362/145; 362/249; 362/806

[58] Field of Search ..... 362/145, 151, 152, 217, 362/219, 225, 227, 249, 252, 806

[56] References Cited

U.S. PATENT DOCUMENTS

| | | | |
|---|---|---|---|
| 2,699,492 | 1/1955 | Cookenboo | 240/73 |
| 2,723,818 | 11/1955 | Hurtzig | 248/106 |
| 3,182,944 | 5/1965 | Laviano | 248/226 |
| 3,189,310 | 6/1965 | Trueson | 248/314 |
| 3,193,229 | 7/1965 | Stock | 248/74 |
| 3,341,699 | 9/1967 | Somermeyer | 240/2 |
| 3,540,687 | 11/1970 | Cuva | 248/316 |
| 3,559,918 | 8/1971 | Patchett | 248/215 |
| 3,578,282 | 5/1971 | Olsen | 248/214 |
| 3,584,795 | 6/1971 | Baird | 240/52 |
| 3,596,859 | 8/1971 | MacDonald | 248/214 |
| 3,731,081 | 5/1973 | Yellin | 362/249 |
| 3,861,632 | 1/1975 | Siilats | 248/223 |
| 3,883,926 | 5/1975 | Reynolds | 24/73 |
| 3,970,837 | 7/1976 | Helm | 240/52.15 |
| 4,128,863 | 12/1978 | Premetz | 362/249 |
| 4,214,688 | 7/1980 | Griffin, Jr. | 224/197 |
| 4,357,653 | 11/1982 | Kovacs | 362/806 |
| 4,482,944 | 11/1984 | Roossine et al. | 362/418 |
| 4,491,902 | 1/1985 | Cangelosi | 362/389 |
| 4,661,891 | 4/1987 | Kitamura | 362/219 |
| 4,714,219 | 12/1987 | Mayse | 248/65 |
| 4,769,749 | 9/1988 | Felski | 362/806 |
| 4,774,646 | 9/1988 | L'Heureux | 362/249 |
| 4,851,977 | 7/1989 | Gary | 362/249 |
| 4,884,178 | 11/1989 | Roberts | 362/249 |
| 4,890,206 | 12/1989 | Lee | 362/249 |
| 4,974,128 | 11/1990 | Prickett | 362/249 |

*Primary Examiner*—Ira S. Lazarus
*Assistant Examiner*—Sue Hagarman
*Attorney, Agent, or Firm*—Hubbard, Thurman, Tucker & Harris

[57] ABSTRACT

A decorative trim lighting system includes an elongated, resilient retaining strip which is formed in a laterally folded configuration and is securable to an exterior surface portion of a building. The bulb socket portions of a decorative light string are removably received in a longitudinally spaced series of openings formed through the strip, and a longitudinally spaced series of bent edge portions of the strip overlie and releasably hold the longitudinal electrical power supply wiring segments interconnecting the sockets. The strip may also be used to slidably and releasably hold enlarged end portions of retaining tab members to which the sockets are secured.

7 Claims, 1 Drawing Sheet

DECORATIVE EXTERIOR TRIM LIGHTING SYSTEM

This application is a continuation-in-part of copending U.S. application Ser. No. 464,200 filed on Jan. 12, 1990, now patent No. 4,974,128, issued Nov. 27, 1990, and entitled "RAPIDLY ADJUSTABLE DECORATIVE EXTERIOR TRIM LIGHTING SYSTEM", such copending application being hereby incorporated by reference herein.

BACKGROUND OF THE INVENTION

The present invention relates generally to decorative trim lighting systems and, in preferred embodiments thereof, more particularly provides significantly improved exterior trim lighting support structures for mounting decorative light "strings" (such as those typically used during the Christmas holiday season) along various exterior surface portions of buildings.

Illustrated and described in my copending U.S. application Ser. No. 464,200, incorporated by reference herein, is a decorative exterior trim lighting system which includes an elongated resilient retaining strip member which may be adhesively or otherwise secured to an exterior surface of a building and is operative to releasably hold a spaced series of support tab members to which the socket and bulb portions of a decorative light "string" are secured. While the elongated retaining strip permits easy and quite rapid attachment of the light string-supporting retaining tab members thereto, and is quite inexpensive to manufacture, in developing the decorative trim lighting system of the present invention it has become desirable to even further simplify and reduce the cost of the light string supporting portion of the system.

It is accordingly a primary object of the present invention to further simplify the light string supporting portion of the overall decorative exterior trim lighting system illustrated and described in my copending U.S. application Ser. No. 464,200.

SUMMARY OF THE INVENTION

In carrying out principles of the present invention, in accordance with a preferred embodiment thereof, uniquely configured retaining strip means are provided which are securable to an exterior building surface to extend longitudinally therealong, and are operative to support a decorative light string of the type comprising a mutually spaced series of bulb sockets operatively receiving the base portions of a series of light bulbs and being operatively connected to longitudinal segments of a length of electrical power supply wiring.

The retaining strip means include a first elongated strip portion securable to the building surface and having a longitudinally spaced series of openings formed therethrough and sized to releasably receive end portions of the bulb sockets. Holding means are carried by the elongated strip portion and are operative to overlie and releasably hold the longitudinal segments of the electrical power supply wiring when the end portions of the bulb sockets are releasably received in the strip portion openings. Accordingly, the light string may be rapidly and easily secured to the retaining strip means simply by positioning end portions of the bulb sockets into the strip openings and operatively engaging the holding means with the longitudinal segments of the power supply wiring extending between the supported bulb sockets.

The retaining strip means are preferably defined by an elongated, laterally folded plastic extrusion having a first side wall portion in which the spaced series of socket-receiving openings are formed, and which is securable to the exterior building surface, and a second side wall portion which overlies the first side wall portion. The second side wall portion has a free side edge in which a longitudinally spaced series of recesses are formed which overlie the socket openings in the first side wall portion and are configured to receive and partially circumscribe the sockets removably received therein.

The longitudinal segments of the free edge positioned between the recesses therein are bent toward the first side wall portion and are operative as the aforementioned holding means to overlie the longitudinal power supply wiring segments and releasably retain them within the longitudinally extending cavity between the first and second side wall portions of the retaining strip. This unique configuration of the retaining strip permits the rapid installation thereon of a light string, and permits the strip to releasably hold both the socket and wiring portions of the installed light string. If desired, the retaining strip may be formed from another resilient material, such as sheet metal.

As an added advantage, the retaining strip may, if desired, be alternatively utilized to slidingly and releasably receive the enlarged end portions of a spaced series of retaining tab members, to which the socket portions of the light string are removably secured, as illustrated and described in my copending U.S. application Ser. No. 464,200.

DETAILED DESCRIPTION

Figure 1:
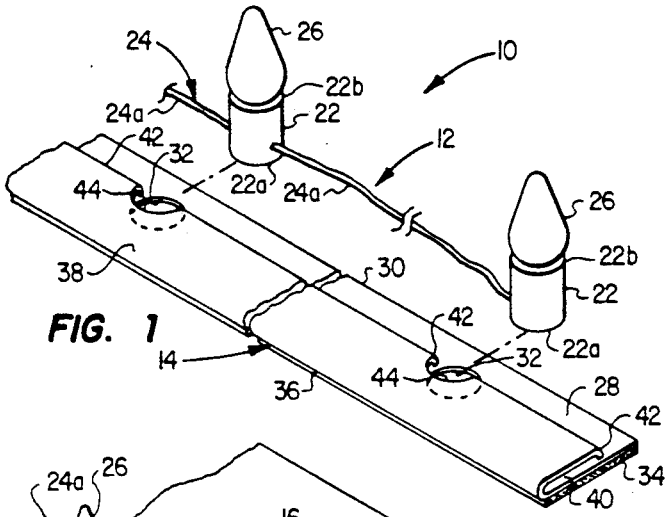
FIG. 1 is an exploded, fragmentary perspective view of an exterior decorative trim lighting system which embodies principles of the present invention and includes a conventional light string and a specially designed light string holding strip.

Perspectively illustrated in FIG. 1 is a longitudinal portion of a decorative exterior trim lighting system 10 which includes a conventional light string 12 and a specially designed elongated, extruded plastic retaining strip 14. As subsequently described, the retaining strip 14 is operative to releasably hold the light string 12, and may be laterally secured to an exterior building surface, such as the top surface 16 of a building parapet 18 (FIG. 2), adjacent the front side 20 of the parapet.

The light string 12 comprises a spaced series of cylindrical bulb sockets 22 having lower end portions $22_a$ operatively interconnected by longitudinal segments $24_a$ of a length of electrical power supply wiring 24, and upper end portions $22_b$ in which a series of light bulbs 26 are received.

The retaining strip 14 has an elongated bottom side wall 28 with a free longitudinal side edge 30. Extending downwardly through the bottom side wall 28 are a longitudinally spaced series of circular openings 32, each of which has a diameter just slightly larger than the diameters of the lower end portions $22_a$ of the sockets 22. A layer of suitable adhesive 34 extends along the underside of the bottom side wall 28 and may be covered by a peel-off strip of protective paper or the like (not shown) that may be removed just prior to the attachment of the retaining strip 14 to the parapet surface 16 as subsequently described.

The left side edge of the lower side wall 28 is connected, by a longitudinally extending joining section 36, to an elongated top side wall 38 of the retaining strip 14 which overlies the bottom side wall 28 and defines therewith a cavity 40 which extends along the length of the strip 14. The top side wall 38 has a longitudinally spaced series of downturned free edge segments 42 which are spaced laterally inwardly of the lower side wall edge 30 and are interdigitated with a longitudinally spaced series of generally semi-circular recesses 44 formed in the free edge of the upper side wall 38. Recesses 44 overlie corresponding leftward portions of the circular openings 32 and have radii substantially equal to those of the circular openings 32.

Figure 3:
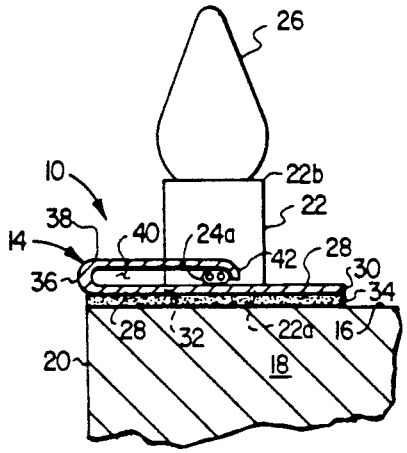
FIG. 3 is an enlarged scale cross-sectional view through the system taken along line 3—3 of FIG. 2.
Figure 2:
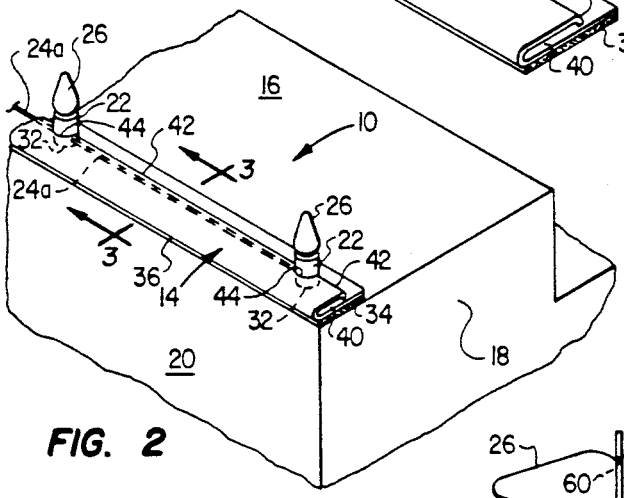
FIG. 2 is a fragmentary perspective view of the trim lighting system operatively secured to an exterior building surface such as the representatively depicted top parapet surface.

Referring now to FIGS. 2 and 3, the trim lighting system 10 is installed on the parapet 18 by adhering the adhesive material 34 to the top parapet surface 16 in a manner such that the retaining strip joining section 36 is closely adjacent and extends parallel to the top front edge of the parapet. If desired, other means may be utilized for securing the retaining strip to the surface to be decoratively illuminated. The light string 12 is then removably secured to the strip 14 by positioning the lower socket ends $22_a$ in the circular strip openings 32 so that the strip recesses 44 partially circumscribe the sockets above the longitudinal wiring segments $24_a$. Additionally, the longitudinal wiring segments $24_a$ are pushed into the strip cavity 40 beneath the downturned strip edge segments 42, the downturned strip edge segments 42 functioning, as best illustrated in FIG. 3, to releasably retain the power wire segments $24_a$ within the strip cavity 40.

In this manner, the light string 12 may be very easily and rapidly connected to the retaining strip 14. The strip 14 securely but removably supports the light string, with the surfaces of the holes 32 and the edge recesses 44 restraining movement of the sockets 22 in a left-to-right direction as viewed in FIG. 3, and the downturned strip edge portions 42 restraining the wiring segments $24_a$ against upward movement in addition to releasably retaining the wiring sections within the strip cavity 40. The installed light string 12 may be just as easily removed simply by removing the sockets 22 from the strip openings 32 and removing the wiring segments $24_a$ from beneath the strip segments 42.

Figure 5:
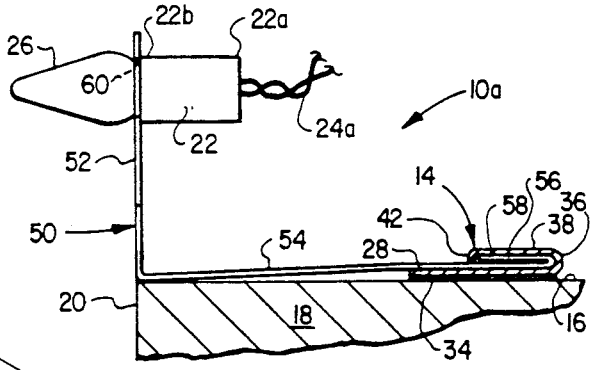
FIG. 5 is an enlarged scale cross-sectional view through the alternate system taken along line 5—5 of FIG. 4.
Figure 4:
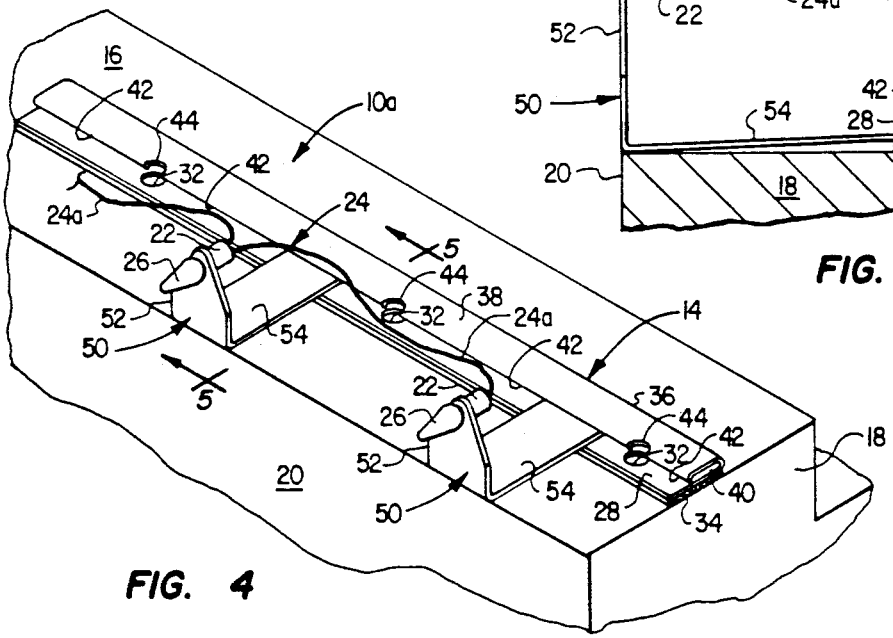
FIG. 4 is a fragmentary perspective view of an alternate embodiment of the system.

An alternate embodiment $10_a$ of the exterior trim lighting system 10 is depicted in FIGS. 4 and 5 and includes the retaining strip 14 just described, and a series of support tab members 50 similar to the support tab members $26_b$ illustrated and described in my copending U.S. application Ser. No. 464,200. Each of the support tabs 50 has a generally L-shaped cross-section defined by a support portion 52 extending generally perpendicularly to an enlarged retaining portion 54 formed by bending an end portion 56 of the tab member back toward the support portion 52, the end portion 56 having an end edge 58.

Each of the support portions 52 has a circular opening 60 therein through which the base portion of one of the bulbs 26 may be inserted and then screwed into the end $22_b$ of one of the sockets 22 to removably secure the bulbs and sockets to the support tabs 50. With the bulbs and sockets secured to the tab members 50, the enlarged retaining portions 54 of the tabs 50 are pushed laterally inwardly into the strip cavity 40 so that, as best illustrated in FIG. 5, the downturned strip edge portions 42 act as abutment surfaces positioned opposite the end edges 58 of the tab members to thereby releasably retain the enlarged retaining portions 54 within the cavity 40. This positions the sockets and bulbs 22, 26 externally of the retaining strip 14 and, as described in my copending U.S. application Ser. No. 464,200, permits the support tabs 50 to be slidingly adjusted along the length of the retaining strip 14 to thereby selectively vary the bulb-to-bulb spacing of the light string 12 relative to the retaining strip 14.

It can thus be seen that the retaining strip 14, as depicted in FIGS. 2 and 3, may be used by itself to very compactly and securely mount the light string 12 on the parapet 18, or upon another exterior building surface, or may be used in conjunction with the support tabs 50 to permit rapid sliding adjustment of the bulb spacing in the supported light string.

The foregoing detailed description is to be clearly understood as being given by way of illustration and example only, the spirit and scope of the present invention being limited solely by the appended claims.

What is claimed is:

1. Apparatus for supporting a light string along a surface to be decoratively illuminated, said light string including a mutually spaced series of bulb sockets having first end portions operatively receiving the base portions of a series of light bulbs, and second end portions operatively connected to longitudinal segments of a length of electrical power supply wiring, said apparatus comprising:

a first elongated strip portion having opposite side edge portions extending along its length, said first elongated strip portion being laterally securable to said surface to extend longitudinally therealong;

a longitudinally spaced series of openings formed through said first elongated strip portion and positioned between its opposite side edge portions, said openings being sized to releasably receive said second end portions of said sockets; and holding means, carried by said first elongated strip portion, for overlying and releasably holding in cavities along a surface of said first elongated strip portion, said longitudinal segments of said length of electrical power supply wiring when said second end portions of said bulb sockets are releasably received in said openings in said first elongated strip portion.

2. The apparatus of claim 1 wherein:

said apparatus further comprises a second elongated strip portion overlying and extending parallel to said first elongated strip portion, said second elongated strip portion having a longitudinally spaced series of edge recesses positioned and configured to overlie said openings in said first elongated strip portion and circumscribe portions of the bulb sockets, and a longitudinally spaced series of edge portions interdigitated with said edge recesses, and said holding means are defined by said longitudinally spaced series of edge portions of said second elongated strip portion.

3. The apparatus of claim 2 wherein:

said longitudinally spaced series of edge portions of said second elongated strip portion have laterally outer sections which are bent toward said first elongated strip portion and are positioned to engage said longitudinal segments of said length of electrical power supply wiring and releasably retain said segments between said first and second elongated strip portions.

4. Apparatus for supporting a light string along a surface to be decoratively illuminated, said light string including a mutually spaced series of bulb sockets having first end portions operatively receiving the base portions of a series of light bulbs, and second end portions operatively connected to longitudinal segments of a length of electrical power supply wiring, said apparatus comprising:

a first elongated strip portion having:

a first side surface securable along the surface to be decoratively illuminated, a second side surface a first longitudinally extending side edge, a second longitudinally extending side edge, and a longitudinally spaced series of openings positioned between said first and second side edges, each of said openings extending between said first and second side surfaces and being sized to releasably receive one of said second end portions of said bulb sockets and restrain movement thereof parallel to said first and second side surfaces; and a second elongated strip portion extending parallel to and overlying said first elongated strip portion, said second elongated strip portion defining with said first elongated strip portion a longitudinally extending cavity within said apparatus and having:

a first side surface facing said second side surface of said first elongated strip portion, a second side surface, a first longitudinally extending side edge joined to said first longitudinally extending side edge of said first elongated strip portion, and a free second longitudinally extending side edge overlying said second side surface of said first elongated strip portion and having a longitudinally spaced series of recesses overlying said openings and sized to circumscribe portions of said bulb sockets, and longitudinal segments interdigitated with said recesses, bent toward said second side surface of said first elongated strip portion, and configured to overlie and releasably hold said longitudinal segments of said power supply wiring within said cavity.

5. The apparatus of claim 4 wherein said apparatus is a plastic extrusion.

6. The apparatus of claim 4 further comprising means for alternatively supporting the light string in a spaced apart relationship with said first and second elongated strip portions in a manner facilitating adjustment of the bulb-to-bulb spacing of the supported light string, said means for alternatively supporting including:

a series of support members removably securable to said bulb sockets and having attachment portions laterally insertable into said cavity for sliding movement along the lengths of said first and second elongated strip portions, said attachment portions having enlarged sections engageable by said longitudinal segments of said second side edge of said second elongated strip portion to releasably restrain laterally outward removal of said attachment portions from said cavity.

7. The apparatus of claim 6 wherein:

each of said attachment portions has a relatively thin, plate-like configuration and an outer end portion bent generally back along the balance of the attachment portion to form said enlarged section thereof.

* * * * *